US008205969B2

(12) United States Patent
Andrews et al.

(10) Patent No.: US 8,205,969 B2
(45) Date of Patent: Jun. 26, 2012

(54) JET STACK WITH PRECISION PORT HOLES FOR INK JET PRINTER AND ASSOCIATED METHOD

(75) Inventors: John Richard Andrews, Fairport, NY (US); Gerald A. Domoto, Briarcliff Manor, NY (US); Nicholas P. Kladias, Fresh Meadows, NY (US)

(73) Assignee: Xerox Corporation, Norwalk, CT (US)

( * ) Notice: Subject to any disclaimer, the term of this patent is extended or adjusted under 35 U.S.C. 154(b) by 780 days.

(21) Appl. No.: 11/985,171

(22) Filed: Nov. 14, 2007

(65) Prior Publication Data

US 2009/0122119 A1 May 14, 2009

(51) Int. Cl.
*B41J 2/045* (2006.01)

(52) U.S. Cl. ..... 347/71

(58) Field of Classification Search ..... 347/70, 347/71

See application file for complete search history.

(56) References Cited

U.S. PATENT DOCUMENTS

| | | | | |
|---|---|---|---|---|
| 5,736,993 | A * | 4/1998 | Regimbal et al. | 347/11 |
| 6,099,111 | A * | 8/2000 | Chang | 347/71 |
| 6,127,198 | A | 10/2000 | Coleman et al. | |
| 6,139,674 | A | 10/2000 | Markham et al. | |
| 6,302,523 | B1 | 10/2001 | Smith et al. | |
| 6,318,841 | B1 | 11/2001 | Coleman et al. | |
| 6,507,001 | B1 | 1/2003 | Kubby | |
| 6,669,336 | B1 | 12/2003 | Kneezel et al. | |
| 6,796,638 | B2 * | 9/2004 | Koike et al. | 347/70 |
| 7,117,572 | B2 | 10/2006 | McGlothlan | |
| 7,143,488 | B2 | 12/2006 | McGlothlan | |
| 7,740,344 | B2 * | 6/2010 | Takahashi et al. | 347/70 |
| 2006/0066686 | A1 * | 3/2006 | Mita | 347/68 |

* cited by examiner

*Primary Examiner* — Ryan Lepisto
*Assistant Examiner* — Erin Chiem
(74) *Attorney, Agent, or Firm* — Maginot, Moore & Beck, LLP

(57) ABSTRACT

A print head for a printer includes a jet stack for passage of ink to media to form an image on the media. The jet stack includes a substrate having a micro actuator. The substrate has an opening through the substrate that is proximate to the micro actuator and a diaphragm bonded to the substrate. The diaphragm has an opening through the diaphragm that is configured for fluid communication with the opening through the substrate. The diaphragm opening has a width that is larger than a width of the opening in the substrate.

14 Claims, 4 Drawing Sheets

JET STACK WITH PRECISION PORT HOLES FOR INK JET PRINTER AND ASSOCIATED METHOD

TECHNICAL FIELD

The system described below relates to printers that eject ink from a print head onto an image receiving member, and, more particularly, to ink jet printers with high density ink jet print heads.

BACKGROUND

Modern printers use a variety of inks to generate images from data. These inks may include liquid ink, dry ink, also know as toner, and solid ink. Both solid ink and ink jet printers utilize a print head that ejects liquid ink onto media, for example paper. The print head in a liquid ink printer typically oscillates back and forth on a transversely moving carriage that is placed over longitudinally advancing media. So-called "solid ink" refers to ink that is loaded into a printer as a solid, which is typically in stick or pellet form. The solid ink is melted within the printer to produce liquid ink that is supplied to a print head for ejection onto media or an intermediate member to generate a printed image from image data. The intermediate member may be a drum onto which the ink is applied as the drum rotates and the print head moves across the drum. These solid ink printers typically provide more vibrant color images than toner or ink jet printers.

The print heads for liquid ink and solid ink printers typically include a plurality of ink jet nozzles that are arranged in a matrix within the print head. The ink is ejected from the nozzle by applying a pressure pulse to the fluid ink in a supply tube. In other print heads, the pressure pulse is generated by a micro actuator. Each ink jet nozzle in a print head has a micro actuator for ejecting ink from the print head. In a thermal ink jet print head, the actuator is a heater while in a piezoelectric ink jet print head, the actuator is piezoelectric material. In other print heads, the pressure pulse may be generated by a micro mechanical membrane.

An ink ejecting print head typically includes an internal manifold that is in fluid communication with the ink jet nozzles through a large number of closely spaced apart ink channels. The ink channels may be formed by, for example, laminating a stack of metal plates. The small dimensions of these channels and the need for tight tolerances to provide uniform nozzle performance in a print head make print head manufacture challenging.

SUMMARY

A jet stack for a printer provides passage of ink to media to form an image on the media. The jet stack includes a substrate having a micro actuator. The substrate has an opening through the substrate that is proximate to the micro actuator and a diaphragm bonded to the substrate. The diaphragm has an opening that is configured for fluid communication with the opening through the substrate. The diaphragm opening has a width that is larger than a width of the opening in the substrate.

A jet stack for passage of ink to media to form an image on the media includes a planarized polymer substrate having a plurality of micro actuators arranged in the planarized polymer substrate. The substrate includes a plurality of openings through the substrate and a diaphragm bonded to the substrate. Each opening is proximate to a micro actuator in a one-to-one relationship. The diaphragm includes a plurality of openings through the diaphragm that are configured for fluid communication with the openings through the substrate. Each opening in the diaphragm is in a one-to-one relationship with an opening in the substrate and each opening in the diaphragm has a width that is larger than a width of the opening in the substrate.

A method for manufacturing a jet stack for use in a printer includes bonding a substrate having a plurality of micro actuators to a diaphragm having a plurality of openings. The openings in the diaphragm expose the substrate at locations other than the micro actuators. The method also includes laser ablating the substrate to form passageways through the substrate that are in fluid communication with the openings in the diaphragm. The laser ablated passageways in the substrate have a width that is less than a width of the openings in the diaphragm.

BRIEF DESCRIPTION OF THE DRAWINGS

Features of the jet stack are apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a jet stacks that eject liquid ink melted in solid ink printers, the jet stacks may be used with any printer that uses a print head to eject liquid ink onto media or imaging members. For example, the jet stacks disclosed below may be used with melted wax inks, water-based inks, and solvent-based inks. In particular, the system may be well suited for print heads for piezoelectric ink jet printers, thermal ink jet printers, and micro electromechanical print heads used in some printers.

Figure 1:
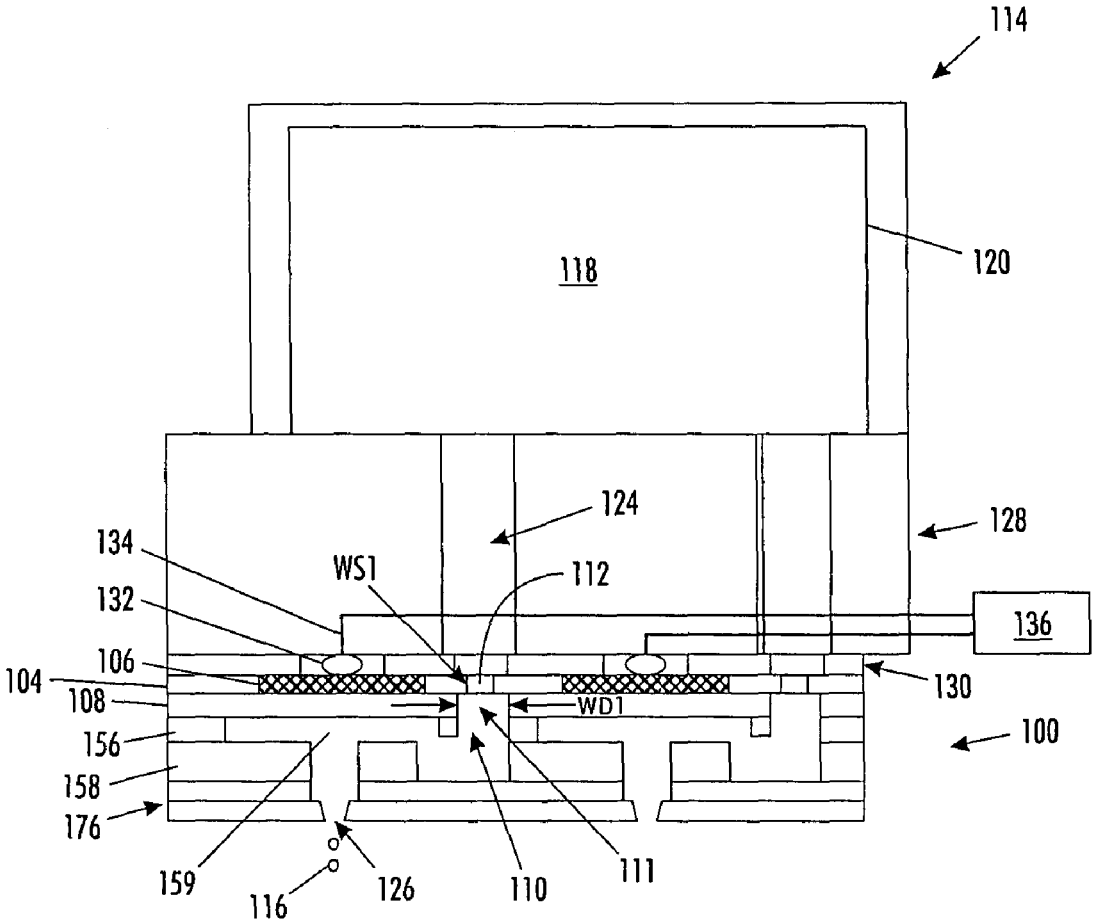
FIG. 1 is a cross-sectional view of a print head showing a jet stack structure.

A portion of a print head, shown in the cross-sectional view of FIG. 1, depicts a jet stack 100 that is used in a printer. The jet stack 100 includes a substrate 104 having micro actuators 106, a diaphragm 108, a body plate 156, an outlet plate 158, and an aperture layer 176. The substrate 104 includes an opening 112 that is proximate the actuator 106. The diaphragm 108 includes an opening 111 that is configured for fluid communication with the opening 110 in the body plate 156 and the outlet plate 158 as well as the opening 112 in the substrate 104. The diaphragm opening 111 has a width WD1 that is larger than a width WS1 of the opening 112 in the planarized polymer portion of substrate 104, which is coplanar with the actuator 106, as described in more detail below. The diaphragm 108 is a resilient, but flexible material, such as a thin layer of stainless steel. The diaphragm bends with the expansion and contraction of actuator 106 to expel ink from ejection chamber 159 through the nozzle 126 in aperture layer 176.

The jet stack 100 is a part of a print head 114, which is used to distribute droplets 116 of ink 118 from an ink manifold 120 to media, such as, sheets of paper. While the print head 114 and the jet stack 100 may be directly connected to the ink manifold 120, a circuit board or flex 128 may be positioned between the ink manifold 120 and the jet stack 100. A standoff layer 130 may also be positioned, as shown in FIG. 1, between the circuit board or flex 128 and the jet stack 100. The standoff layer 130 includes an electrical connector 132, for example, conductive adhesive, to connect the micro actuator 106 by way of electrical connectors 134 to controller 136. The controller 136 generates electrical signals to energize the actuator 106 and eject ink drops 116 from the nozzle 126. The conduit 124 provides a passageway for the ink 118 in the manifold 120 to reach the ink jet stack 100 and be ejected by the micro actuator 106 from the nozzle 126. The pressure and flow of droplets 116 from the nozzle 126 are governed, at least in part, by the inlet ink flow resistance in the path defined by conduit 124, openings 110, 111, 112, chamber 159, and the nozzle 126. This resistance is predominantly determined, in general, by the smallest of the openings, which is the opening 112 having a width WS1 in the substrate 104. By very precisely controlling the width WS1 of the opening 112 in the substrate 104 with manufacturing techniques, such as laser ablation, the size of the droplets 116 may be more accurately controlled, thereby improving the quality of the image generated with the ejected ink drops.

Referring now to FIGS. 2-7, construction of a jet stack having more precisely manufactured substrate openings is shown in greater detail. The substrate 204 in FIG. 2 includes a plurality of micro actuators 206. The micro actuators 206 may be in the form of any micro actuator and may, for example, include a heater, a micro-electromechanical membrane, or a piezoelectric actuator. If the micro actuator is a piezoelectric actuator, the actuator is made from a piezoelectric material, such as, lead zirconate titanate (commonly known as PZT).

Figure 2:
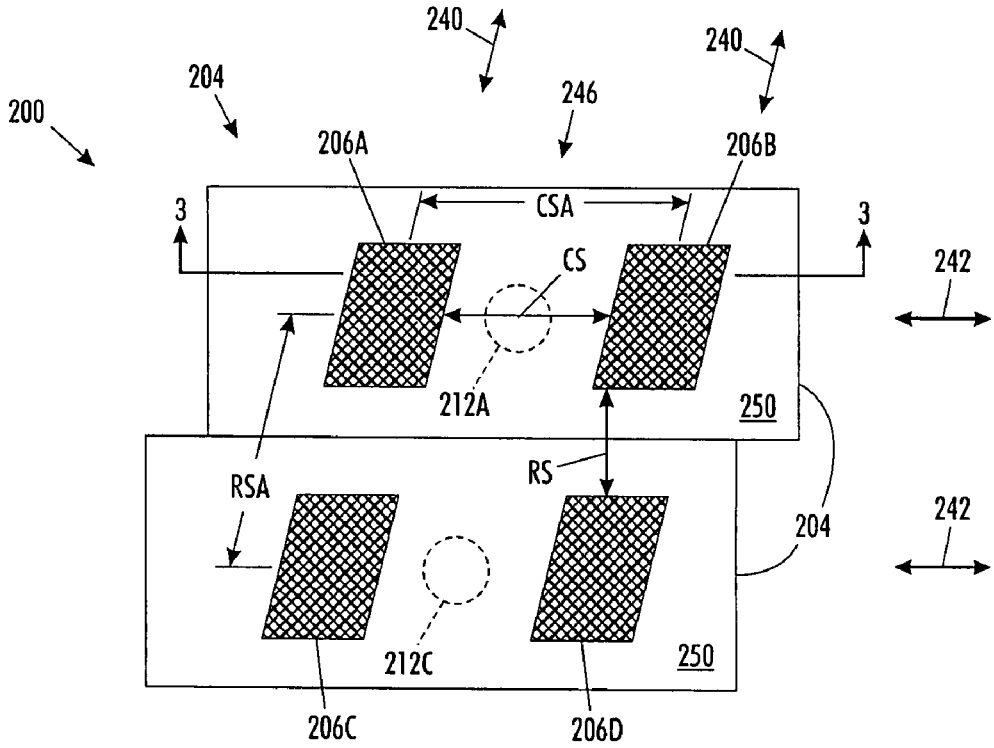
FIG. 2 is a bottom plan view of a jet stack substrate showing a plurality of micro actuators.

With continued reference to FIG. 2, the micro actuators 206 may be four spaced apart piezoelectric micro actuators, 206A, 206B, 206C, and 206D. Each of the micro actuators has a corresponding substrate opening 212, although FIG. 2 only depicts substrate opening 212A and substrate opening 212C to simplify the view. The micro actuators 206 are typically arranged in a uniformly spaced array of columns 240 and rows 242. The columns 240 and rows 242 are separated by, for example, column spacing CS and row spacing RS, respectively. The column spacing CS and row spacing RS may have the same or different dimensions. The distances CS and RS between adjacent micro actuators 206 may typically be from around 100 to 600 micrometers. The distance CS and RS between adjacent micro actuators 206 may be large enough, for example, around 300 micro meters, such that openings 212 may be formed between adjacent micro actuators 206. The micro actuators 206 may be spaced apart a distance CSA for the columns spacing of the actuators and a distance RSA for the row spacing of the actuators. The reader should appreciate that the distances CSA and RSA may be quite small for commercially acceptable printing devices and typically may be around 300 micrometers. The reader should understand that the substrate openings 212 may be located between rows rather than between columns as shown in FIG. 2.

Figure 3:
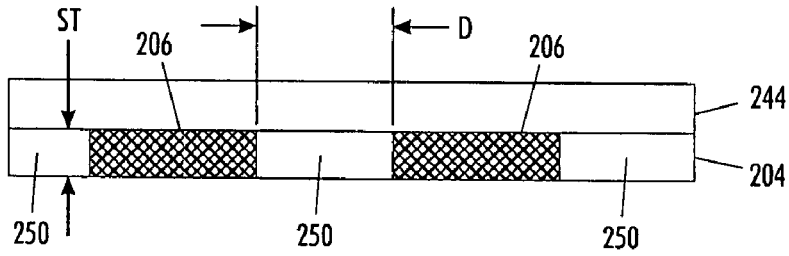
FIG. 3 is a cross sectional view of the substrate of FIG. 2 with a carrier layer mounted to the top surface.

The micro actuator 206 may be manufactured in any suitable fashion. As shown in FIG. 3, the micro actuators 206 are typically manufactured with a carrier layer 244 mounted to the top surface of the substrate 204. The substrate 204 includes a plurality of micro actuators 206 separated by saw cuts or other methods for separating the PZT actuators. The saw cuts or other separator are described as kerfs in the following discussion. The carrier layer 244 is utilized to provide support for and to interconnect each of the spaced apart micro actuators 206 as an intermediate structure in the assembly process. The kerfs are filled with polymer material, such as epoxy or silicone to produce a planar structure 250 around the actuators 206. The polymer portion 250 and the micro actuators 206 form a flat surface so the substrate 204 has a uniform thickness ST.

Figure 4:
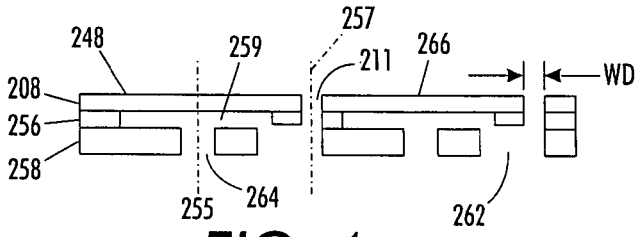
FIG. 4 is a cross-sectional view of an assembly comprised of a diaphragm, a body plate, and an outlet plate.

A cross-sectional view is shown in FIG. 4 of a diaphragm 208, a body plate 256, and an outlet plate 258. Alternatively, this three part structure may be constructed as a unitary structure, rather than being comprised of multiple plates, and made of any suitable durable material, such as a polymer or a metal. If the diaphragm 208 is made of a metal, the metal may be sheet metals, such as stainless steel or aluminum. Passageways 259 are configured and arranged to provide fluid communication between the diaphragm inlets 211 and the outlets 264 in the outlet plate 258. The diaphragm openings 211 are arranged in arrays of rows and columns positioned along center lines 257. For metal diaphragms, the openings 211 may be manufactured by commercial methods such as by chemical etching.

Figure 5:
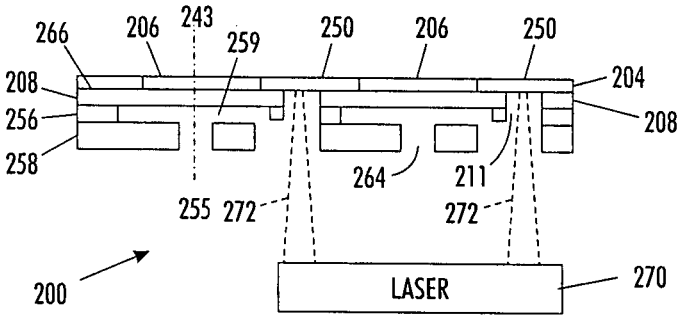
FIG. 5 is a cross sectional view of a partial ink jet stack formed by mounting the substrate of FIG. 3 to the assembly of FIG. 4.

A cross-sectional view of a partial ink jet stack in which the diaphragm 208 is assembled with the substrate 204 is shown in FIG. 5. The bottom surface 266 of the substrate 204 is positioned against the top surface 248 (FIG. 4) of the diaphragm 208 to form a partial ink jet stack 200. Center lines 243 of the micro actuators 206 are aligned with center lines 255 of the outlets 264 in the outlet plate 258. The surfaces 248 and 266 are secured together by an adhesive. The adhesive may be a thermoplastic or thermoset, for example, epoxy. The adhesive may be cured by typical methods such as by assembling the partial ink jet stack in a press with heat to cure the remaining thin layer of adhesive between the diaphragm 208 and the substrate 204. Following the bonding of diaphragm 208 to substrate 204, the carrier 244 is removed to provide the assembly shown in FIG. 5.

After the partial jet stack is assembled, the openings 212 may be formed in the substrate 204 using any suitable method and at any suitable point in the manufacture of the print head. Although the carrier layer has been removed from the partial jet stack before the ablation operation shown in FIG. 5 is performed, the carrier layer 244 may remain on the substrate 204 during formation of the openings 212. The openings 212 may be formed by laser ablating the substrate 204 with a laser 270. The laser 270 may be a variety of laser types, such as excimer, fiber, or solid state lasers. Preferably, an excimer laser is used in an imaging mode with a mask having apertures. The apertures of the mask are imaged by the laser onto the polymer 250 with an image that is smaller than the opening 211 in the diaphragm 208. Such lasers are commercially available and can typically ablate polymers including epoxy. The laser 270 provides a beam 272 that may sequentially illuminate and overfill each opening in a mask to form the openings 212 in substrate 204. Alternatively, special optics may be used to illuminate areas of the substrate 204 to form each of the openings 212 in the jet stack 200. The passageways 211 in the diaphragm 208 may serve as the mask for the laser beam 272. Alternatively, a mask may be placed on the top surface of the substrate 204 that is not bonded with the diaphragm or on the top surface of the carrier layer 244, if the carrier layer 244 remains attached to the substrate 204 during formation of the openings 210. In these various methods for producing the holes in the polymer layer, the wavelength of the laser and the numerical aperture of the imaging system determine the size of the openings. These parameters may be adjusted to provide openings that are less than 1 micron.

The openings 212 in the substrate 204, particularly when manufactured with a laser, have an opening width WS (FIG. 7) that is quite uniform from opening to opening. For example, the laser ablation method results in all of the openings formed in a partial ink jet stack to have a diameter that may be within +/− two percent of the mean average for all of the openings in the partial ink jet stack. Forming the openings 212 with a uniform width WS provides more uniform inlet resistance at the openings 212, which enables the pressure within the diaphragm cavities 259 to be more consistent from ink jet nozzle to ink jet nozzle for better quality image.

Figure 6:
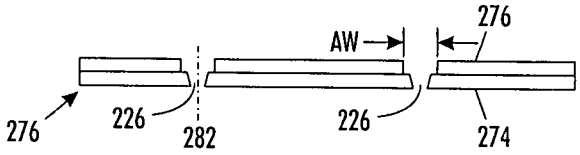
FIG. 6 is a cross-sectional of an aperture layer.

Referring now to FIG. 6, an aperture layer 276 has an aperture 226. While the aperture layer 276 may be a unitary component, the aperture layer 276 may include a nozzle plate 274 that is mounted to an aperture brace 276. The apertures 226 have an aperture width AW and have an aperture center line 282. The aperture layer 276, including the aperture brace 276 and the nozzle plate 274, may be made of any suitable durable materials such as, for example, metals and/or polymers. For example, the aperture layer 276 may be made of polyimide or stainless steel. The aperture brace 278 may be brazed to the nozzle plate 274 or glued thereto by a b-staged epoxy or by a thermoplastic polymer.

Figure 7:
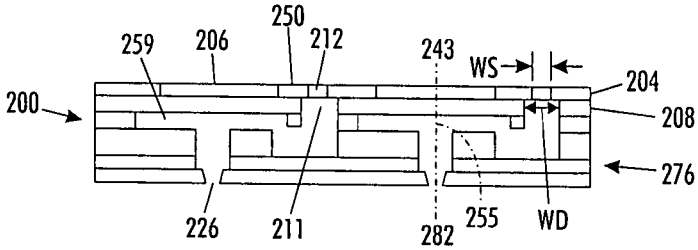
FIG. 7 is a cross sectional view of the aperture layer of FIG. 6 mounted to the assembly of FIG. 5.

Referring now to FIG. 7, the aperture layer 276 is shown mounted against the diaphragm 208 of the partial jet stack 200. Center lines 282 of the apertures 226 of the aperture layer 276 are aligned with center lines 255 of the outlet openings 264 in the outlet plate 258 and the center lines 243 of the micro actuators 206. The aperture layer 276 may be secured to the body plate 258 by any suitable means such as, for example, an adhesive. The adhesive may be a thermoplastic, for example, a polyimide. Alternatively, the adhesive may be a b-staged epoxy. If a b-staged epoxy is used, the adhesive may be an epoxy that may be cured in an environment of, for example 200 psi and 200 degrees centigrade. Such a b-staged epoxy may permit the curing of the adhesive at lower temperatures and pressures.

As shown in FIG. 7, the openings 212 formed in the substrate 204 by the laser 270 have a width WS which is smaller than width WD of the diaphragm openings 211. Thus, the restriction of ink flow from the manifold to the nozzle 226 is primarily restricted by the substrate openings 212. By providing the substrate openings 212 with accurate and consistent widths WS, the inlet resistance of the ink flow path is highly consistent to provide uniform performance of ink flow through the nozzles 226.

Figure 8:
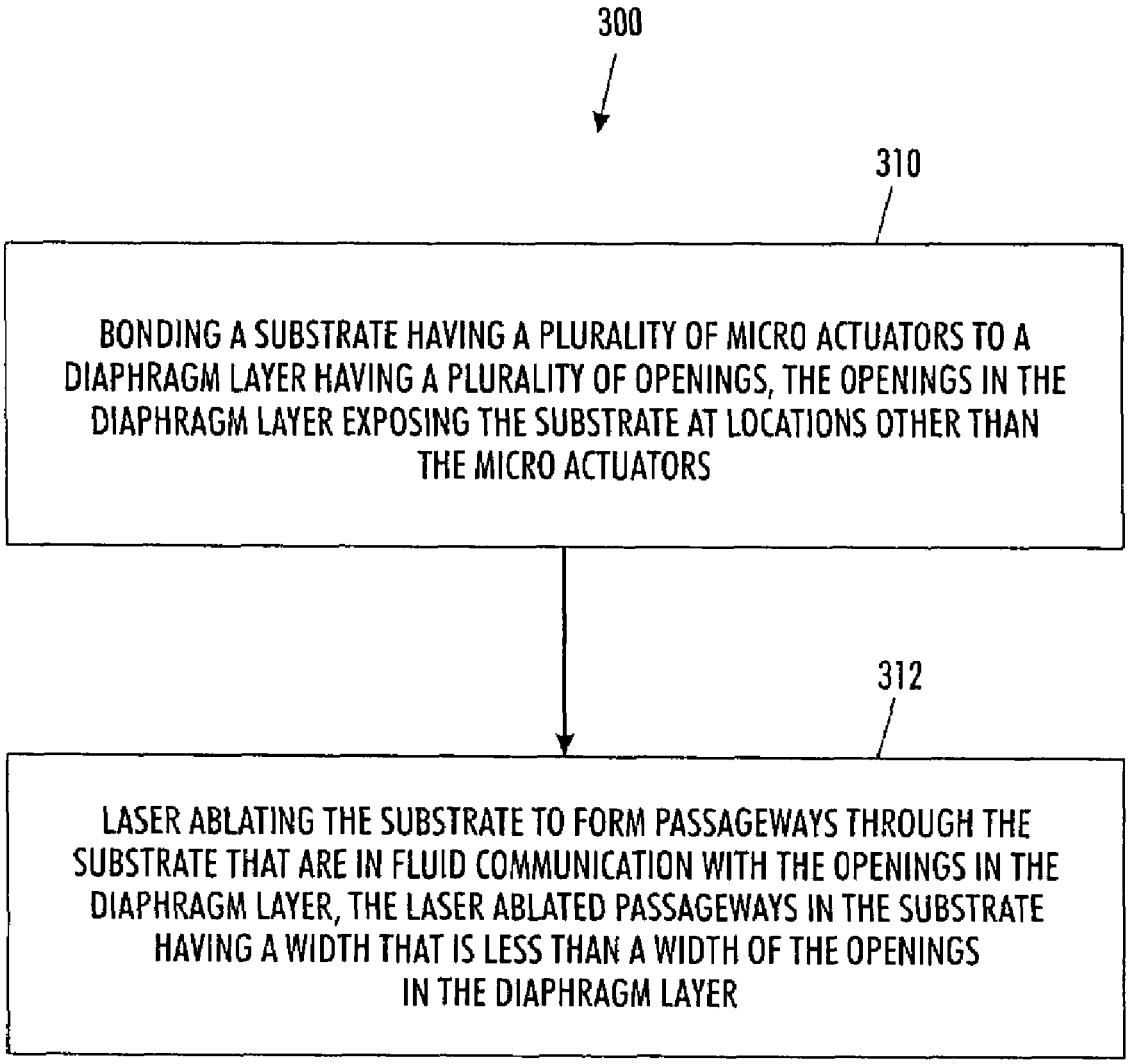
FIG. 8 is a process flow diagram of a method for manufacturing a jet stack for use in a print head.

Referring now to FIG. 8, a method 300 for manufacturing a jet stack for use in a printer is shown. The method 300 includes bonding a substrate having a plurality of micro actuators to a diaphragm having a plurality of openings (block 310). The openings in the diaphragm expose the substrate at locations other than the micro actuators. The method 300 also includes laser ablating the substrate to form passageways through the substrate that are in fluid communication with the openings in the diaphragm (block 312). The laser ablated passageways in the substrate have a width that is less than a width of the openings in the diaphragm. The bonding may further include aligning the openings in the diaphragm with the substrate to expose the substrate at locations proximate to the micro actuators of the substrate. The laser ablation may further include overlaying a mask on a surface of the substrate that is not bonded with the diaphragm to form the passageways through the substrate with the laser ablation. The laser ablation may further include illuminating the openings in the diaphragm with a laser to form the passageways in the substrate. The laser ablation may be performed with an excimer laser or with a solid state laser.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A jet stack for use in a printer, said jet stack comprising:

a polymer substrate in which a micro actuator is positioned to be co-planar with the polymer substrate, the polymer substrate including an opening having only a first width throughout the polymer substrate, the opening through the polymer substrate being proximate to the micro actuator in the polymer substrate; and a diaphragm bonded to the polymer substrate, the diaphragm including an opening having only a second width throughout the diaphragm that is aligned with and adjacent to the opening in the polymer substrate, the second width of the opening in the diaphragm being configured for fluid communication with the first width of the opening through the polymer substrate and the second width of the opening throughout the diaphragm being greater than the first width of the opening throughout the polymer substrate.

2. The jet stack of claim 1, the polymer substrate being comprised of a planarized polymer.

3. The jet stack of claim 2, the opening in the planarized polymer being formed by laser ablation.

4. The jet stack of claim 1:

the polymer substrate having a plurality of micro actuators distributed in the substrate to be co-planar with the polymer substrate and a plurality of openings through the polymer substrate having the first width throughout each opening in the polymer substrate, the plurality of openings through the polymer substrate being arranged in a one-to-one correspondence with the micro actuators in the polymer substrate; and the diaphragm includes a plurality of openings through the diaphragm having the second width throughout each opening in the diaphragm, the second width of the openings in the plurality of openings through the diaphragm being configured for fluid communication with the first width of the openings in the plurality of openings in the polymer substrate in a one-to-one correspondence.

5. The jet stack of claim 1, the micro actuator being comprised of a piezoelectric actuator.

6. The jet stack of claim 1, the micro actuator being comprised of a micro-electromechanical membrane.

7. The jet stack of claim 4, the diaphragm and the polymer substrate being bonded to one another with epoxy.

8. The jet stack of claim 7, the openings in the plurality of openings through the polymer substrate being formed by laser ablation of the substrate and epoxy exposed through the plurality of openings through the diaphragm.

9. A jet stack comprising:

a planarized polymer substrate in which a plurality of micro actuators are positioned to be co-planar with the planarized polymer substrate, the planarized polymer substrate including a plurality of openings through the substrate, each opening being proximate to a micro actuator in a one-to-one relationship and each opening having only a first width throughout each opening; and a diaphragm bonded to the substrate, the diaphragm including a plurality of openings through the diaphragm, each opening in the diaphragm having only a second width throughout each opening, the second width of the openings through the diaphragm being configured for fluid communication with the first width of the openings through the substrate, each opening through the diaphragm being in a one-to-one relationship with an opening through the substrate and the second width being larger than the first width.

10. The jet stack of claim 9:

the micro actuators in the planarized polymer substrate being comprised of piezoelectric actuators.

11. The jet stack of claim 9, the plurality of micro actuators defining a distance between adjacent micro actuators of around 100 to 600 micrometers.

12. The jet stack of claim 9, the openings through the planarized substrate having a width within 10 percent of an average width for the openings in the planarized substrate.

13. The jet stack of claim 9, the openings in the planarized polymer substrate being formed by laser ablation.

14. The jet stack of claim 9, an epoxy layer between the planarized polymer substrate and the diaphragm to bond the diaphragm to the planarized polymer substrate.

* * * * *